United States Patent [19]

Butcher

[11] Patent Number: 5,006,282

[45] Date of Patent: Apr. 9, 1991

[54] AIR COOLER PUMP MEANS

[75] Inventor: Richard H. Butcher, Hendon, Australia

[73] Assignee: F. F. Seeley Nominees Pty., Ltd., South Australia, Australia

[21] Appl. No.: 425,420

[22] Filed: Oct. 23, 1989

[30] Foreign Application Priority Data

Oct. 24, 1988 [AU] Australia ..... PJ1111

[51] Int. Cl.[5] ..... B01F 3/04

[52] U.S. Cl. ..... 261/29; 384/220; 384/222

[58] Field of Search ..... 261/29; 384/220, 222

[56] References Cited

U.S. PATENT DOCUMENTS

| | | | |
|---|---|---|---|
| 2,062,290 | 12/1936 | Bott | 384/220 |
| 2,387,473 | 10/1945 | Spitzka | 261/29 |
| 2,620,722 | 12/1952 | Owens | 261/29 |
| 2,730,905 | 1/1956 | Pence | 74/206 |
| 2,757,613 | 8/1956 | Dry | 103/6 |
| 2,934,022 | 4/1960 | Rodick et al. | 261/29 |
| 2,998,714 | 9/1961 | Bonzer | 62/312 |
| 3,171,699 | 3/1965 | Maxey | 384/222 |
| 3,885,767 | 5/1975 | Olowinski et al. | 384/222 |
| 4,269,573 | 5/1981 | Goode | 417/362 |
| 4,298,235 | 11/1981 | Squirrell | 384/220 |
| 4,338,264 | 6/1982 | Seeley | 261/29 |
| 4,542,996 | 9/1985 | Brissette et al. | 384/222 |
| 4,572,808 | 2/1986 | Seeley | 261/29 |
| 4,615,844 | 10/1986 | Dickison et al. | 261/29 |
| 4,744,677 | 5/1988 | Tanaka et al. | 384/222 |

*Primary Examiner*—Tim Miles

*Attorney, Agent, or Firm*—Brown, Martin, Haller & McClain

[57] ABSTRACT

A fan shaft of an evaporative cooler is horizontal and carries a driving pulley at one end. A pump spindle is vertical, carrying a driven pulley at its upper end and pump impeller at its lower end, the impeller being in a pump housing in the cooler water tank. A circular section elastomeric band drives the spindle from the fan shaft.

6 Claims, 2 Drawing Sheets

AIR COOLER PUMP MEANS

This invention relates to a pump arrangement wherein the pump is arranged to be driven by the motor shaft or fan shaft of an air cooler. The invention is directed to air coolers of the evaporative type but can be adapted to other products.

BACKGROUND OF THE INVENTION

Heretofore difficulty has been encountered in overcoming the general arrangement of a pump and the drive means for it when a separate pump motor is not used, and for example in an earlier Patent of ours (U.S. Pat. No. 4,615,844), a pump was direct coupled to a fan shaft, and use was made of a priming tube which always contained some water so that upon commencement of operation, water Was initially driven down into the pump space before being discharged therefrom. This is obviously inconvenient and not always as reliable as may be hoped.

In another patent of ours (U.S. Pat. No. 4,572,808), the fan shaft was horizontal and the pump spindle vertical, and the drive between the two was a friction drive. Right angle friction drives have also been used in U.S. Pat. No. 2,998,714 (Bonzer); U.S. Pat. No. 2,730,905 (Pence); U.S. Pat. No. 2,757,613 (Driver), and U.S. Pat. No. 4,269,573 (Goode); but friction drives do not deliver high torque, especially under moist conditions. A very satisfactory arrangement can be used wherein the fan shaft is vertical (our U.S. Pat. No. 4,338,264), but such an arrangement is not generally applicable to axial flow fans, such as are generally used on smaller coolers.

BRIEF SUMMARY OF THE INVENTION

In this invention, a fan shaft of an evaporative cooler is horizontal and carries a driving pulley at one end. A pump spindle is vertical, carrying a driven pulley at its upper end and pump impeller at its lower end, the impeller being in a pump housing in the cooler water tank. A circular section elastomeric band drives the spindle from the fan shaft.

More specifically, the invention consists of a pump housing within the water tank, a driving pulley on the fan shaft, a pair of vertically spaced bearings fixed with respect to the fan housing, a spindle journalled for rotation in the bearings, a pump impeller on the lower end of the spindle within the pump housing, a driven pulley on the upper end of the spindle, and a band type drive coupling the driven and driving pulleys.

With this arrangement, the bearings can be very simply positioned on the fan frame, and the band type drive can perform a secondary function of assisting retention of the bearings in position, in turn simplifying assembly.

BRIEF DESCRIPTION OF THE DRAWINGS

An embodiment of the invention is described hereunder in some detail with reference to, and is illustrated in, the accompanying drawings, in which.

Figure 1:
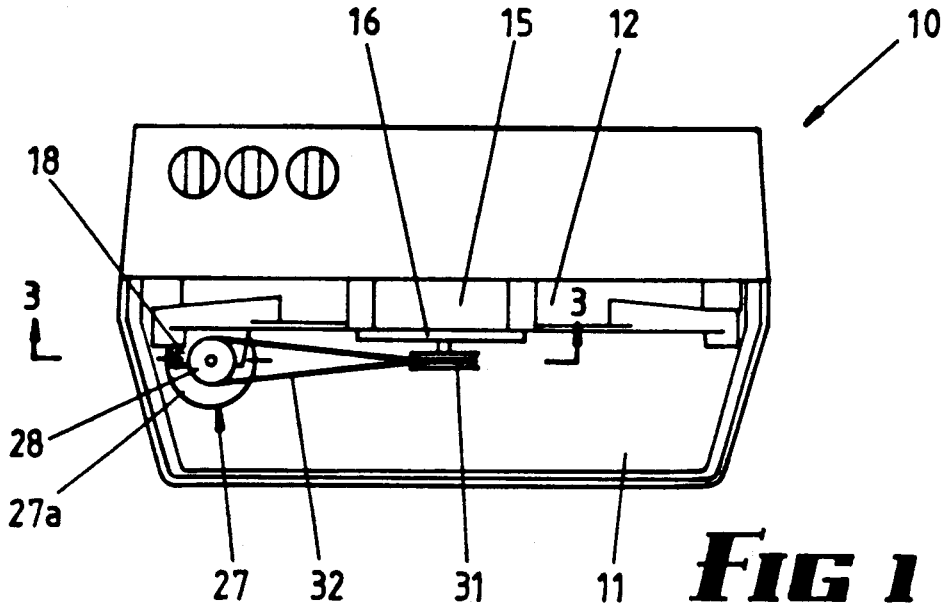
FIG. 1 is a plan view of a cooler, but with the rear/-side panel moulding removed to illustrate the pump arrangement of this invention.
Figure 2:
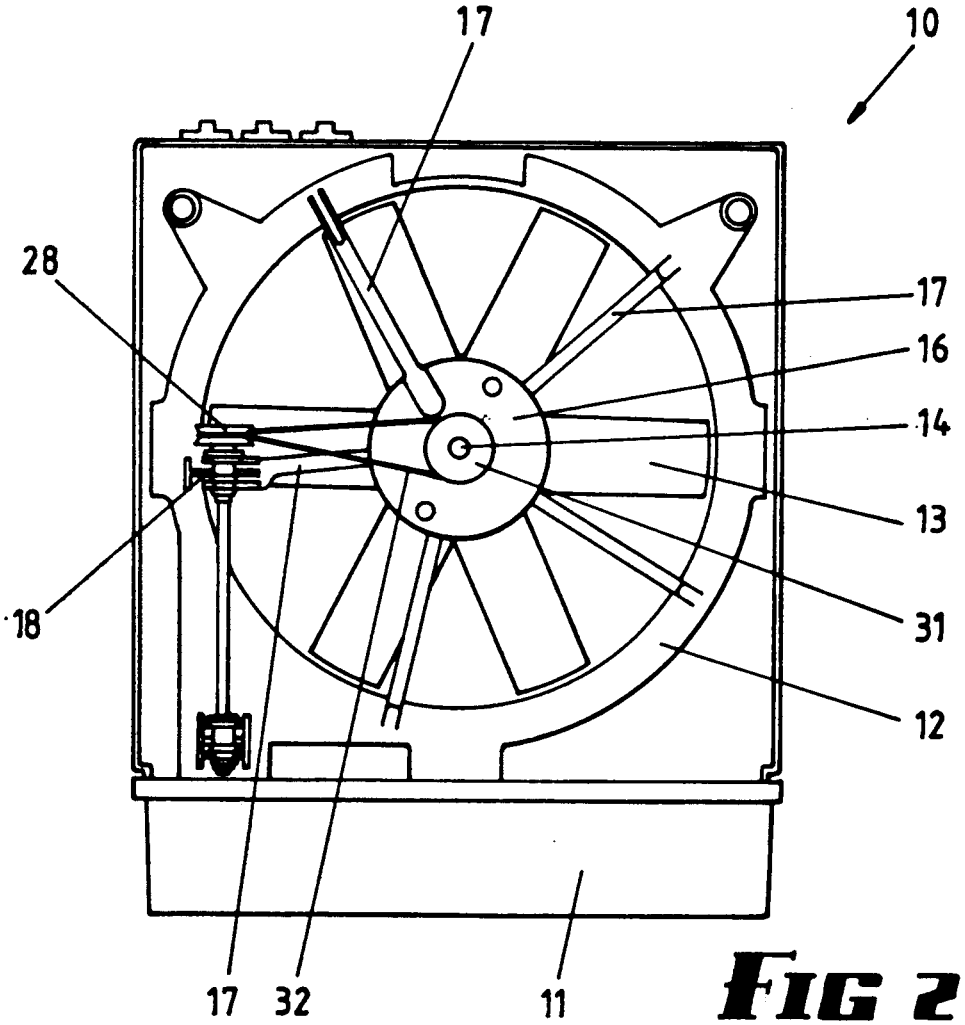
FIG. 2 is a rear elevation of FIG. 1.

In this embodiment, an evaporative air cooler 10 comprises a water tank (sump) 11 which supports a fan housing 12 in which a fan 13 is rotatable, the fan 13 being on a shaft 14 which is also the shaft of a motor 15 or coupled thereto. The fan shaft 14 is journalled in bearings 16 carried on frame ribs 17.

Figure 4:
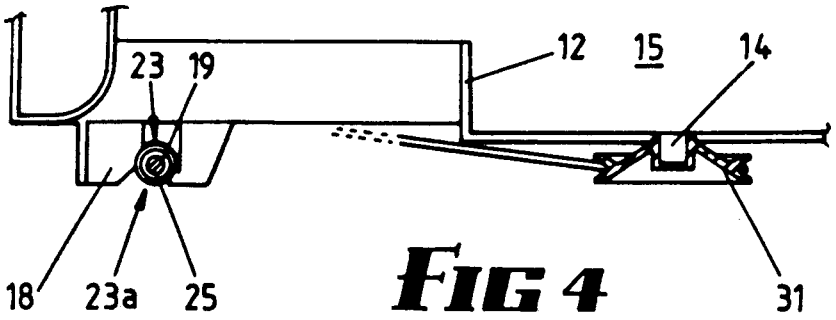
FIG. 4 is a plan section on line 4–4 of FIG. 3.
Figure 3:
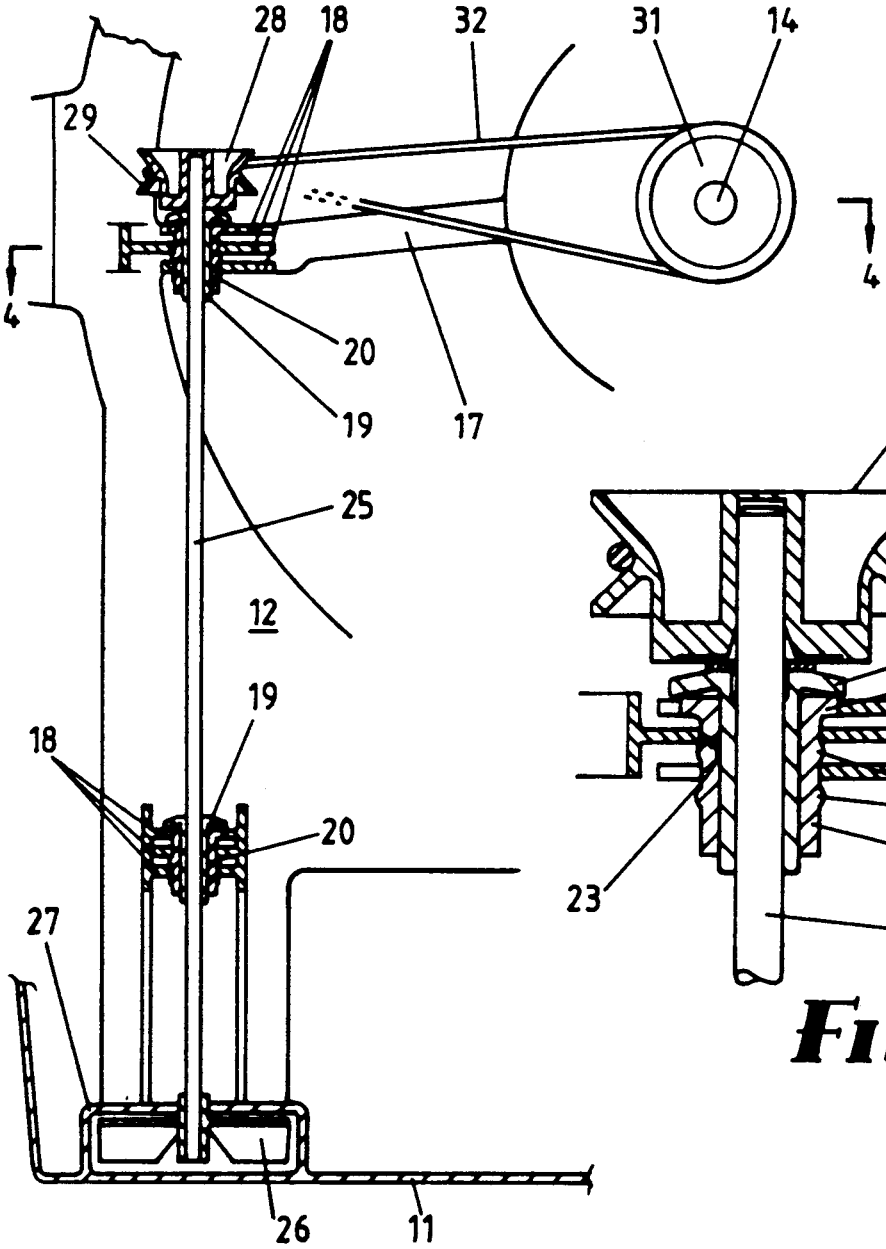
FIG. 3 is a part section taken on line 3—3 of FIG. 1, but drawn to a larger scale.
Figure 5:
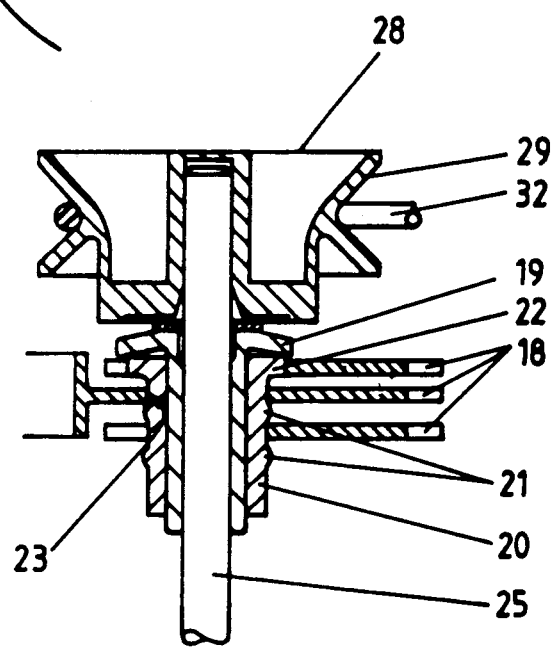
FIG. 5 is a fragmentary section showing the driven pulley and bearing assembly of FIG. 3 to a larger scale.

The fan housing 12 is provided with two sets of bearing support lugs 18, and these support respective bearings 19 against displacement, each bearing 19 being in an elastomeric sleeve 20 having two spaced annular ribs 21 surrounding it (FIG. 5). Each set of support lugs comprises a group of three rigid lugs, the upper lug 18 engaging a flange 22 in an abutment mode, and the intermediate lugs 18 engaging the sleeve 20 between its ribs 21, which position the sleeve against vertical displacement. As shown in FIG. 4, the configuration of lugs 18 defines in plan a part circular aperture 23 having an entry space **23*a* less than the aperture diameter through which the resilient sleeve 20 is "snapped" upon assembly, the sleeve 20 being slightly larger than aperture 23** to provide an interference fit.

The bearings 19 rotationally support a vertically extending stainless steel spindle 25 for rotation, the lower end of the spindle 25 carrying an impeller 26 in a pump housing 27 in the base of water tank 11, and the upper end extending into and secured to a driven pulley 28 the curved periphery 29 of which is circularly concave.

The shaft 14 carries on it a driving pulley 31 and this is coupled by means of a circular section rubber belt 32 to the driven pulley 28, so that rotation of the shaft imparts a drive to the spindle 25 and thereby to the impeller 26. The entry space **23*a* is directed away from the driving pulley 31 by a degree sufficient that tension in the belt 32 will assist to retain the bearings 19, and their sleeves 20, in the apertures 23**.

For assembly, it is merely necessary to form a sub-assembly of spindle 25, bearings 19 with their sleeves 20, pulley 29 and impeller 26, and this sub-assembly can then be snapped into position in the support lugs 18. The belt 32 can then be quickly and easily positioned over the driving and driven pulleys 28 and 31. To facilitate this simple and efficient assembly, the pump housing 27 has a removable semicircular part **27*a* which is located after the assembly of the spindle sub-assembly to the lugs 18**.

The invention has many advantages over prior art. Not only is the assembly quickly and easily effected, but the parts thereof are inexpensive but are readily accessible and simply replaceable. The pump 21 is immersed under water level so that there is no need for any priming. The opening for water flow to impeller 20 can be in the underside of the pump so that if water levels drop excessively, the pump impeller will not cause spray of water to pass over the fan motor. All parts can be made of non-corrosive material, for example plastics and stainless steel. The belt/pulley arrangement provides a simple means whereby pump speed can be varied for different size coolers.

I claim:

1. A pump arrangement for an evaporative air cooler of the type having a fan on a shaft rotatable about a horizontal axis and contained in a fan housing surmounting a water tank, and arranged to impel a flow of air through a wet pad to thereby cause evaporation and consequential cooling of the air, comprising, a pump within the water tank, a driving pulley on the fan shaft, a pair of vertically spaced bearings supported by bearing support means provided on the fan housing, a spindle journalled for rotation in the bearings, a pump impeller on the lower end of the spindle within the pump housing, a driven pulley on the upper end of the spindle, and a band type drive coupling the driven and driving pulleys.

2. A pump arrangement according to claim 1 wherein the band type drive is an elastomeric belt of circular cross-section.

3. A pump arrangement according to claim 1 comprising a pair of said bearing support means, each of which, in plan, defines a part-circular aperture having an entry space of less width than the aperture diameter, respective elastomeric sleeves surrounding said bearings, the sleeves being of diameter slightly larger than the aperture diameter, but sufficiently deformable to pass through respective said entry spaces into the part-circular apertures.

4. A pump arrangement according to claim 3 wherein each said bearing support means comprises a set of lugs outstanding from the fan housing and vertically spaced from each other, and each said elastomeric sleeve comprises at least one annular rib surrounding it which, upon assembly, is located between a pair of said lugs.

5. A pump arrangement according to claim 3 wherein said entry is directed away from said driving pulley by a degree sufficient that tension in the band type drive will assist to retain the bearings in their respective said part-circular apertures.

6. A pump arrangement according to claim 3 wherein said pump housing is in the base of the water tank, the pump housing comprising a removable semi-circular part, of sufficient size that, upon its removal, the pump impeller can be inserted into the housing.

* * * * *